United States Patent [19]

Jochum

[11] 4,063,672

[45] Dec. 20, 1977

[54] CHARGE FEEDING ARRANGEMENT FOR AN EXPLOSIVE CHARGE DRIVEN SETTING GUN

[75] Inventor: Peter Jochum, Meiningen, Austria

[73] Assignee: Hilti Aktiengesellschaft, Schaan, Liechtenstein

[21] Appl. No.: 671,153

[22] Filed: Mar. 29, 1976

[30] Foreign Application Priority Data

Apr. 1, 1975 Germany ..... 2514256

[51] Int. Cl.[2] ..... B25C 1/14

[52] U.S. Cl. ..... 227/10

[58] Field of Search ..... 227/8, 10, 11

[56] References Cited

U.S. PATENT DOCUMENTS

| | | | |
|---|---|---|---|
| Re. 27,628 | 5/1973 | Newton et al. | 227/10 |
| 3,330,108 | 7/1967 | Kuaule et al. | 227/11 |
| 3,540,141 | 11/1970 | Butler | 227/10 |
| 3,659,768 | 5/1972 | Brunelle | 227/10 |

*Primary Examiner*—Granville Y. Custer, Jr.

*Attorney, Agent, or Firm*—Toren, McGeady and Stanger

[57] ABSTRACT

In an explosive charge driven setting gun for inserting fastening elements into a hard receiving material, caseless charges are positioned in an opening in a holding member prior to being inserted into the firing chamber. A feed member in the gun displaces the charges from the holding member opening into the firing chamber and a plunger located on the opposite side of the firing chamber from the feed member is movable through the chamber for clearing an unfired charge or any residue of a fired charge. The holding member can be a magazine or a separate slide movably mounted in the gun housing. Preferably, the opening in the holding member, the feed member, the plunger and the firing chamber all have the same cross sectional shape viewed transversely of the firing direction of the gun.

19 Claims, 10 Drawing Figures

CHARGE FEEDING ARRANGEMENT FOR AN EXPLOSIVE CHARGE DRIVEN SETTING GUN

SUMMARY OF THE INVENTION

The present invention is directed to an arrangement for feeding caseless charges into the firing chamber of an explosive charge driven setting gun used for driving fastening elements into hard receiving or target materials, such as concrete, steel and the like. The setting gun includes a barrel, a holding member located adjacent the rear end of the barrel and having at least one opening or recess for caseless propellant charges, a firing chamber positioned adjacent to the holding member and a feeding member for inserting charges from the holding member into the firing chamber.

Because of cost considerations, there is a tendency to use caseless propellant charges in explosive charge driven setting guns instead of cartridge cases of brass or copper which contain the explosive charge. Since it is inconvenient at best to collect spent cartridge cases on a construction site for reuse, valuable raw materials can be saved if caseless charges are utilized. Setting guns are presently available on the market which use caseless charges. However, the models presently available have not been satisfactory and have not been effective in replacing guns which use conventional cartridge cases.

As in setting guns which employ charge-containing cartidge cases, there are two principal types of guns for caseless charges: guns for single-shot operation and guns with the charges in a magazine.

Due to their small size, it is difficult to handle caseless charges individually, particularly with protective gloves. Further, such charges are also highly susceptible to damage by crumbling and moisture, for instance, moisture in the form of perspiration on the hand of an operator. The presence of moisture in a charge prevents its ignition. As a result, rather than inserting the charges individually into the firing chamber, they should be fed into the chamber from a magazine. To prevent ignition of adjacent charges, it is advisable to displace the charge from the magazine before it is ignited. Removal from the magazine also eliminates the risk of magazine breakage by the high gas pressures developed during ignition.

In a known setting gun, caseless charges are arranged in a magazine duct. The charges are biased by spring force from the duct into a slide having a recess which receives the caseless charge. A lever moves the slide into alignment with the firing chamber. The charge is then inserted into the firing chamber by means of a sleeve-type feed member. The charge is ignited by impacting a firing pin against it.

Occasionally, when caseless charges are used, the charge is not ignited or is only incompletely ignited, When incomplete ignition occurs, a residue of the charge must be removed from the firing chamber before a new charge is inserted. In presently known guns it is necessary to disassemble the gun to effect the required clearing of the chamber. Further, special tools are required which are not always available on a construction site.

Even though a charge burns completely, certain residues remain in the firing chamber. Such residues are deposited on the chamber wall and, in the course time, prevent the introduction of new charges into the chamber. Accordingly, the firing chamber must be cleared periodically of such residue. However, such cleaning of the chamber involves an interruption in the operation of the gun with the result that the required clearing is frequently omitted on construction sites and leads to operating problems with the gun.

In another known setting gun, caseless charges are removed individually from the magazine by a complicated mechanism consisting of a plunger, springs and cams which involve movement through 90° during the feeding action of the charge into the firing chamber. However, such a feeding device is highly susceptible to operating problems. Further, the safety of such a device as well as that of the above-mentioned gun is inadequate. Since there is no automatic ejection of unfired charges or partly burnt charges in either of the guns mentioned, it is possible, for example, to present two or more charges into the range of the firing chamber by repeating the charge loading movement. If two or more charges are ignited simultaneously accidents may occur with unforeseeable consequences.

Accordingly, the primary object of the present invention is to improve the safety of a setting gun which operates with caseless charges.

In accordance with the present invention, a feed element is located on one side of the combustion chamber and a plunger is provided on the opposite side which has a cross sectional shape corresponding to that of the chamber so that it can pass through and clear the chamber.

Based on the invention, the plunger can eject charges which have not been ignited and can return them to the recesses or openings in the holding member. The reinserted charges can then be moved out of the range of the firing device. Since the cross section of the plunger corresponds substantially to the cross section of the firing chamber any fragments of an ignited charge remaining in the chamber can be removed by the action of the plunger.

It is particularly advantageous if the feed member and the plunger are arranged coaxially. Accordingly, the feeding of the charge into the firing chamber as well as the ejection of any unignited or unburnt charge back into the holding member can be effected along one axis. If the axis is arranged parallel to the main axis of the gun, a movement of individual parts of the gun relative to one another can be effected, if necessary, as the gun is pressed against the target material for effecting the feeding and clearing action on the firing chamber.

Since the cross sectional shape of the plunger corresponds substantially to the lateral shape of the firing chamber, it is expedient for the plunger to form one of the sides of the firing chamber. By conforming the shape of the plunger exactly to the cross sectional shape of the firing chamber, no shoulders are formed on which firing residues can collect. Because the plunger is admitted into the chamber with the combustion gases, the gas pressure acting on the chamber must be absorbed. Such absorption can be achieved by supporting the plunger in the gun itself or by resting the barrel of the gun on the receiving material.

Since the firing chamber must be closed on all sides to insure complete combustion during the ignition of the charge, the feed member, which serves to insert the charge from the holding member into the chamber, forms or defines one side of the chamber. Accordingly, the combustion gases also act on the feed member. Therefore, the feed member must be supported in the gun housing or on the receiving or target material. The support on the target material can be direct or indirect, for example, over the barrel. The feed and possible reinsertion of the charges relative to the holding member is effected in two opposite directions. Since caseless charges generally have no projections or lugs, such as correspond to the bottom edge of a cartridge case, the movement can be effected only by pushing or sliding. As a result, it is important if the recesses in the holding member are designed as openings. In this way, the feed member can pass through the holding member to effect a complete ejection of the charge from the holding member. With such an arrangement, damage to the charges can be prevented to a great extent.

It is economically advantageous if a magazine acts as a holding member. Such a magazine is characterized in that it has several spaced recesses for holding the caseless charges. A magazine permits the trouble-free removal of unfired or incompletely fired charges. Further, any combustion residue remaining in the firing chamber can also be removed by the same action. Since the magazine serves only as a holding member and is not a part of the firing chamber, it is not exposed to pressure or heat stresses and inexpensive materials of low quality can be used. So-called one-way magazines are particularly recommended for such use, while more durable materials are advisable for use in refillable magazines.

Various magazine shapes can be utilized. One particularly useful design is a band-shaped magazine. The number of charges to be accommodated in a band-shaped magazine can be selected at random in accordance with the limits set by practical handling. By employing a suitable material, the magazine can be wound in the form of a spiral or coil, accommodating a great number of charges in a small space. Further, in addition to band-shaped magazines, disk-shaped magazines can also be employed.

If a magazine is not used for supplying the charges, that is, if they are supplied within a duct in the gun, it is advisable to use a slide as the holding member. Such a slide has at least two end positions, in one end position it is aligned with the opening from the magazine duct in the gun housing and in the other position it is aligned with the firing chamber. The displacement of the slide can be effected by pressing the gun against the target material or by moving the slide manually.

To prevent any damage to the charges when they are being displaced from the holding member, it is helpful if the cross sectional shape of the feed member corresponds substantially to the cross sectional shape of the recess or opening in the holding member. Such an arrangement prevents any breakage when a charge is displaced from the holding member avoiding any partial feed of the charge into the firing chamber. While minor differences in cross section are possible, the feed member must not extend outwardly beyond the circumferential periphery of the charge holding recess or opening in the holding member.

In a preferred embodiment of the setting gun in accordance with the present invention, the feed member is a pin shaped element disposed parallel to the firing axis of the gun and displaceable relative to the firing chamber. Only a relative movement of the two parts is required for the desired operation and it is irrelevant whether one or both parts are displaceable relative to the housing.

For a compact design of the gun it is advisable if the feed member, the recesses in the holding member, the firing chamber and the plunger have substantially the same cross sectional shape viewed transversely of the axis of the gun. In this way the firing chamber and the recess or recesses in the holding member form a closed system within which a charge can be displaced or reciprocated by the feed member and the plunger.

Setting guns embodying the present invention which employ slides with openings are preferably supplied with a control element which traverses the opening in the slide. By means of the control element only the leading charge in the magazine duct is introduced into the opening in the slide with the following charges being retained within the duct. When the slide is positioned with the opening at the outlet from the magazine duct, the control element is positioned within the opening.

When the slide is moved into position for feeding the charge into the firing chamber the control element must return into its original starting position. Therefore, it is advisable if the control element is spring mounted in the gun housing. With the limited space available in a setting gun, it is advantageous if the control element is attached to the end of a leaf spring. A sufficiently long leaf spring permits a substantially parallel displacement of the control element without requiring any special guide elements.

Since the control element must be displaced in a direction transverse to the movement of the slide from one position to another, it is advantageous if the slide has a cam surface for effecting the displacement of the control element. Such a cam surface can be designed as a part of the surface of the slide through which the control element moves. In a preferred embodiment, the cam surface is provided by an inclined abutting surface on the side of a slot in the slide through which the control element moves and which side of the slide is adjacent to the magazine duct.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
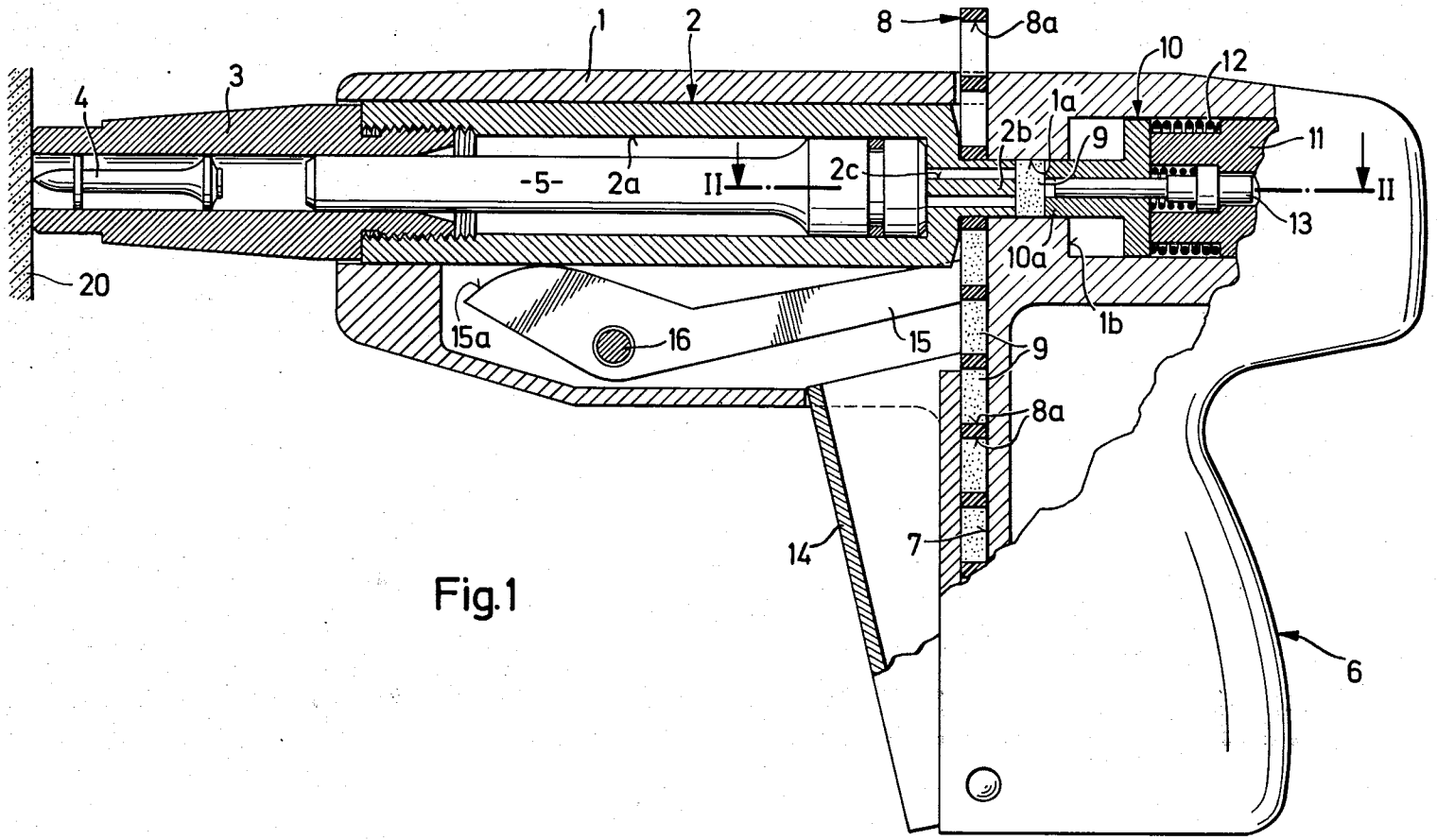
FIG. 1 is a side view, partly in section, of a setting gun embodying the present invention with the barrel of the gun pressed against the receiving or target material.

FIG. 1 shows one embodiment of a setting gun in accordance with the present invention. Mounted in a gun housing 1 is a barrel 2 arranged for axial displacement within the housing. A bolt or fastening element guide 3 is threaded into the front end of the barrel 2. A fastening element 4 is shown in position within the guide 3, ready to be inserted into the target or receiving material 20. The barrel has a bore 2*a* located rearwardly of the bolt guide 3 and a piston 5 is mounted within the gun for axial displacement within the bore and the bolt guide. At its rear end, the gun has a handle 6 extending laterally from the housing 1. Extending through the handle 6 and the housing 1 is a magazine channel 7 which extends perpendicularly to the main axis of the gun, the axis of the barrel. A band-shaped magazine 8, that is, a magazine having an elongated rectilinear strip shape, is positioned within the magazine channel 7. Magazine 8 includes a number of spaced recesses 8*a* in which caseless propellant charges 9 are located. At its rear end, the barrel has a pin-shaped feed member 2*b* extending axially rearwardly. On the opposite side of the magazine channel 7 from the barrel is a firing chamber 1*a*. When the front end of the guide 3 is pressed against the receiving material 20, the guide and barrel are displaced rearwardly through the gun housing in the axial direction of the barrel and the charge in the magazine aligned with the barrel is displaced rearwardly by the feed member 2*b* into the firing chamber 1*a*. Aligned rearwardly of the barrel within the gun housing is an axially displaceable breech part 10. The forward end of the breech part 10 has a pin-shaped plunger 10*a* which defines the rearward side or face of the firing chamber. In effect, the firing chamber 1*a* is provided within a bore through the housing rearwardly of and aligned with the barrel. As shown in FIG. 1, the front face of the firing chamber 1*a* is provided by the rear end of the feed member 2*b* while the rear face of the firing chamber is defined by the forward end of the plunger 10*a*. Rearwardly of the breech part 10 is a bush 11 fitted within the housing 1 and a spring 12 extends between the rear face of the breech part 10 and a shoulder formed on the outer surface of the bush. The spring 12 normally biases the breech part 10 forwardly of the bush 11. In the housing a charge firing device is provided, however, only a firing pin 13 and a trigger 14 are illustrated. Further, since such elements are conventional and well known no further descripton is provided. Mounted in the gun housing below the barrel, as shown in FIG. 1, is a two-arm lever 15 which is pivoted for movement about an axis or pin 16 for moving the magazine 8. Forwardly of the pin 16, as viewed in FIG. 1, the lever has a cam surface 15*a*. As the guide 3 and barrel 2 are pulled outwardly from the gun housing 1, the barrel rides over the cam surface 15*a* and effects over the lever a movement of the magazine 8 by one charge spacing. Though not shown, a spring biases the cam surface 15*a* upwardly against the barrel 2. When the barrel 2 is displaced forwardly of the lever 15, the cam surface 15*a* pivots in the clockwise direction, as viewed in FIG. 1, about the pin 16 with the opposite end of the lever moving downwardly for one charge spacing of the magazine. When the barrel is pushed back into the gun housing 1 it pivots the cam surface 15*a* downwardly in the counterclockwise direction about the pin 16 and the opposite end of the lever moves upwardly carrying the magazine with it for one charge spacing.

Figure 2:
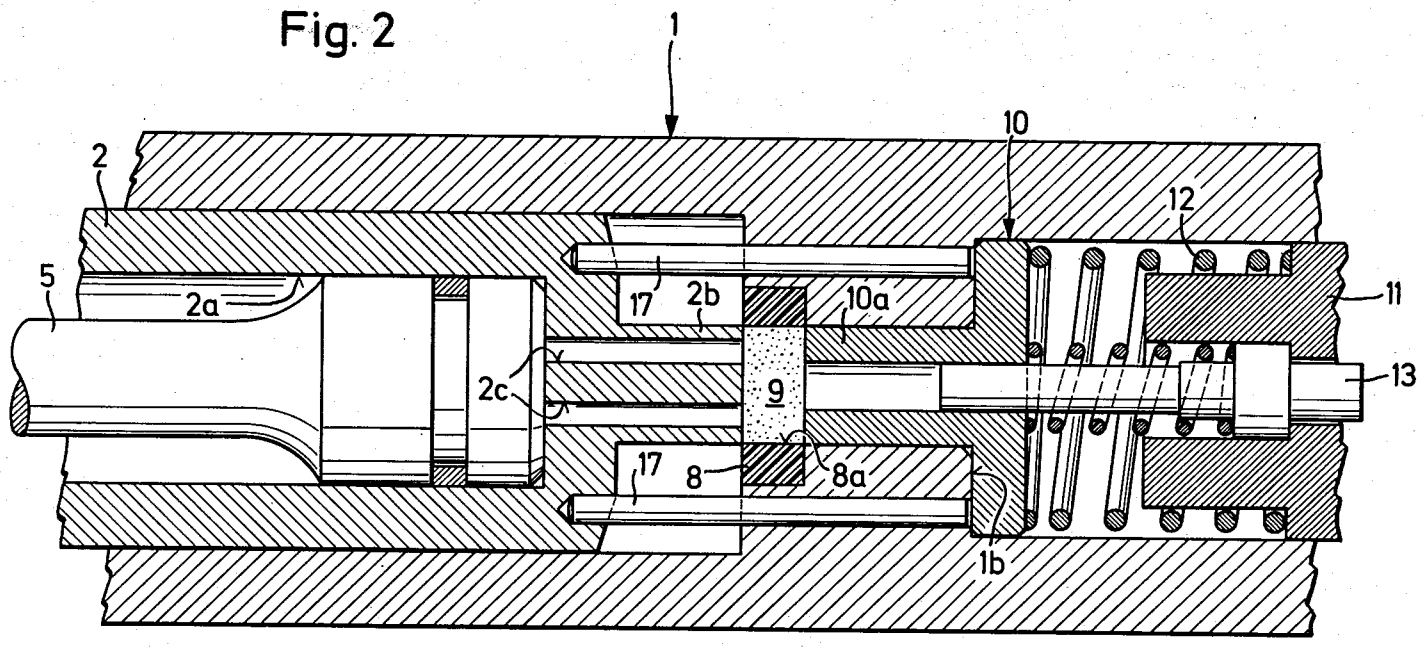
FIG. 2 is an enlarged partial sectional view of the gun shown in FIG. 1 taken along the line II—II but with the barrel of the gun shown removed from the receiving material.

In FIG. 2 a section of the setting gun is shown taken along the line II—II in FIG. 1, however, the barrel is not pressed against the receiving material 20. As a result, the breech part 10 is pushed forwardly, that is in the firing direction, by the force of spring 12 until it contacts a stop 1*b* formed by the housing. The forward end of the plunger 10*a* contacts the rear face of a charge 9 located within an opening or recess in the magazine 8. To assure that the force acting on the rear face of the charge is not too high, barrel 2 is supported by pins 17 on the breech part 10. However, the pins 17 can also be arranged on the breech part or on both the barrel and the breech part. The length of the pins 17 must, in any case, be dimensioned so that an interval remains between the feed member 2*b* on the rear end of the barrel and the front end of the plunger 10*a* on the breech part 10, which interval corresponds to the thickness dimension of a charge. When the front end of the setting gun is pressed against the receiving material, that is the front end of the guide 3, the barrel 2 by means of its feeding member 2*b* displaces the charge 9 and the breech part 10 rearwardly into the position shown in FIG. 1. In FIG. 1 the setting gun is in the firing position. When the charge is ignited by the firing pin 13, the feed element 2*b* serves as an ignition abutment. Combustion gases generated by the firing of a charge flow through channels 2*c* in the rear end of the barrel and there contact the rear end of the piston 5 for displacing it forwardly through the bore 2*a* and the guide 3 for driving the fastening element 4 into the receiving material.

Figure 3:
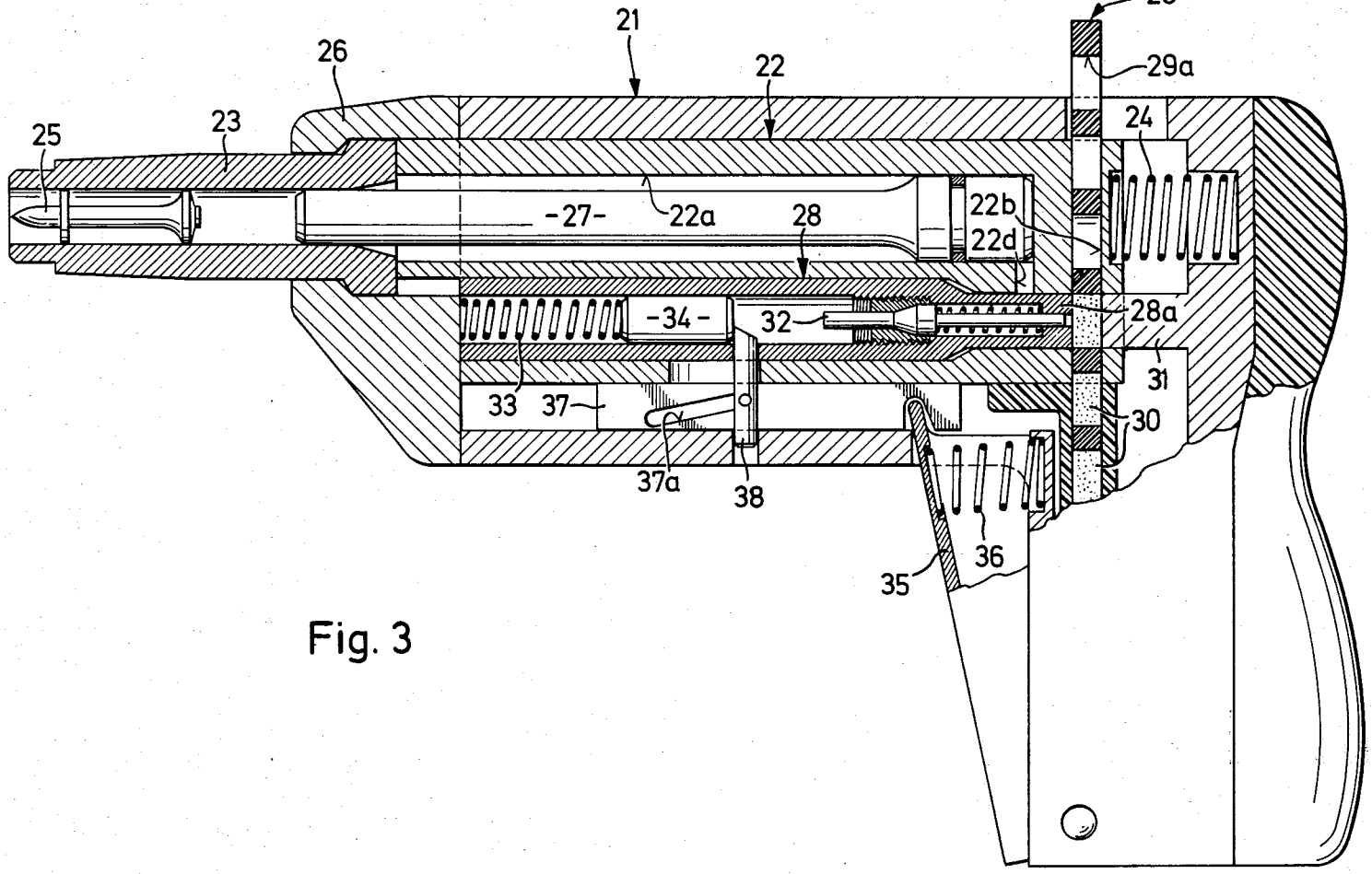
FIG. 3 is a side view, partly in section, of a setting gun illustrating another embodiment of the present invention, however, with the barrel of the gun not pressed against the receiving material.
Figure 4:
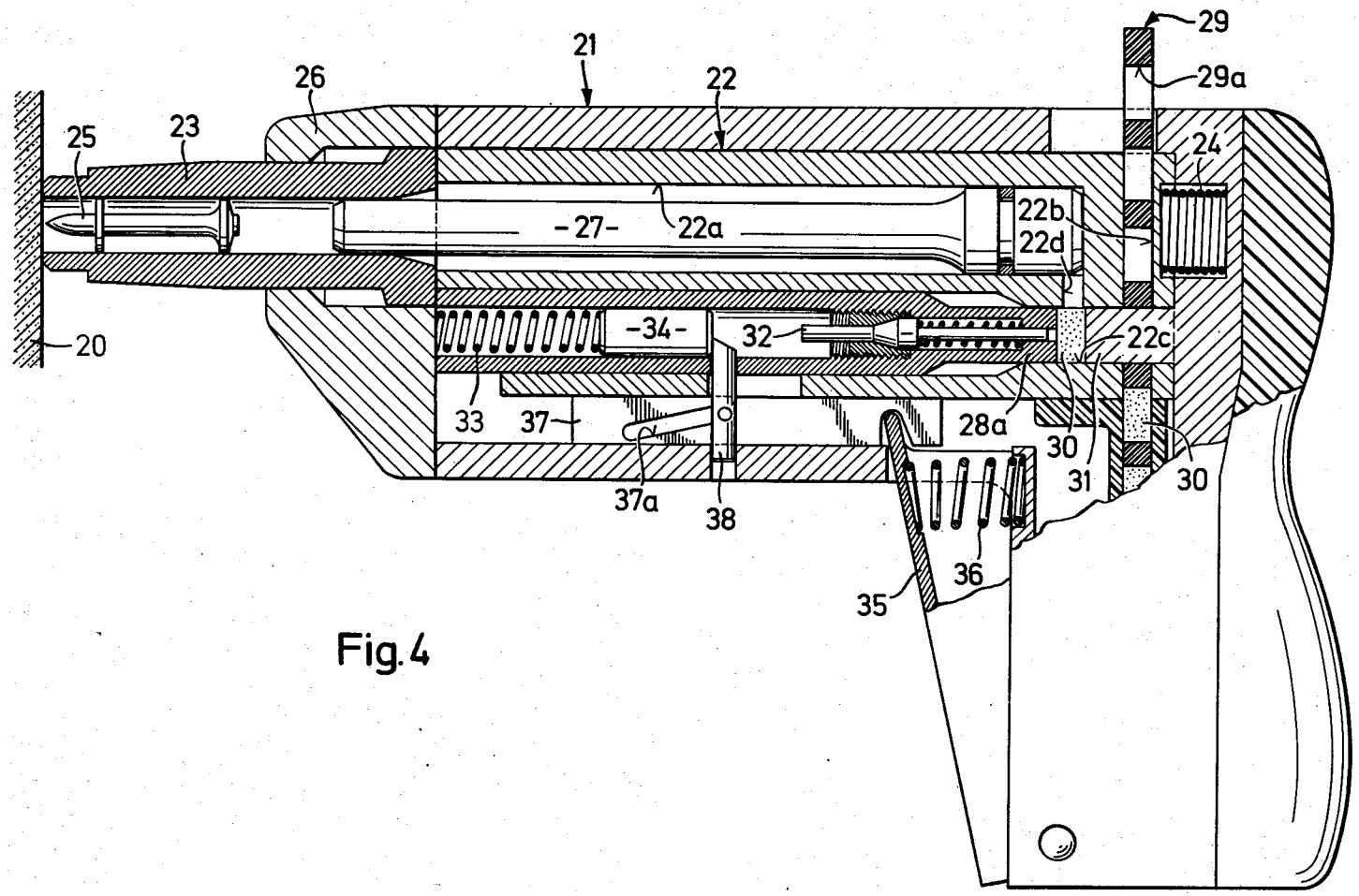
FIG. 4 is a view similar to FIG. 3, however, with the barrel of the gun pressed against the receiving material.

In FIGS. 3 and 4 an embodiment of the setting gun is shown in accordance with the present invention. The main difference from the setting gun represented in FIGS. 1 and 2 is that the feed member for ejecting a charge from the magazine into the firing chamber is not coaxial with the axis of the barrel but is displaced outwardly from but parallel to the axis. Such an arrangement results in a compact gun of reduced length.

Mounted for limited axial displacement in the housing 21 is a barrel 22. A bolt guide 23 is positioned in front of the forward end of the barrel and is also displaceable within the housing in the axial direction. Aligned with the opposite end of the barrel and located within the housing 21 is a compression spring 24. Bolt guide 23 forms a bore affording a continuation of the bore through the barrel and a bolt or fastening element 25 is positioned within the guide for insertion into the receiving or target material. The bore in the barrel 22 forms a piston guide 22*a* coaxial with the bore in the bolt guide 23. At the front end of the housing 21, a cap 26 is positioned to prevent the barrel from displacement out of the housing. A driving piston 27 is mounted within the piston guide bore 22*a* and the bore through the guide 23 so that the piston drives the fastening element into the receiving material as it is driven forwardly. It can be noted that the front end of the piston rides in surface contact with the bore surface of the guide 23 while the enlarged head end of the piston rides in surface contact with the guide surface 22*a* within the barrel. In a bore in the gun housing below the barrel and extending in parallel relation with the axis of the barrel is a sleeve 28. At the rear end of the barrel a magazine channel 22*b* extends through the housing perpendicularly to the axis of the barrel. A band-shaped magazine 29 is positioned within the magazine channel 22*b* and has spaced openings 29*a* into which caseless propellant charges 30 can be positioned. A feed member 31 is formed in the rear end of the housing and is arranged coaxially with the sleeve 28. The cross sectional shape of the feed member 31 viewed in a plane extending transversely of the axis of the barrel corresponds to the shape of the openings 29*a* in the magazine 29.

Sleeve 28 at its rear end facing toward the magazine 29 has a plunger 28*a* which is traversed by an ignition or firing device. The firing device consists of a firing pin 32, a spring 33 and a firing hammer 34. The firing action is commenced by a trigger 35 mounted on the handle of the gun housing which acts against a spring 36 and is engaged within a slide 37 mounted in the housing below the sleeve 28. A pin 38 is positioned within the housing and is slidably fitted into a slot 37*a* by a pin-shaped projection. The slot 37*a* extends obliquely of the axis of the barrel. The compression of spring 33 and the return of the ignition hammer 34 into the position shown in FIG. 3 are effected by a lever, not shown, arranged on the side of the gun. When the forward end of the guide 23 is pressed against the receiving material, both the guide and barrel are pushed rearwardly into the gun housing into the position shown in FIG. 4.

FIG. 4 shows the setting gun illustrated in FIG. 3 in position ready to be fired. As mentioned above, the front end of the guide 23 has been pressed against the receiving material 22 so that both the guide and the barrel are pressed rearwardly in the housing 21. As a result of this rearward movement, the charge 30 located in the magazine and aligned between the sleeve 28 and the feed member 31 is displaced from the magazine into a firing chamber 22*c* located below the rear end of the piston guide bore 22*a* in the barrel. Firing chamber 22*c* is closed on its forward and rearward sides by the plunger 28*a* and by the feed member 31, respectively. The combustion gases produced when a charge 30 is ignited, flow through a bore 22*d* in the rear end of the barrel into the piston guide bore 22*a* where the gases act against the end face of the head of the driving piston 27 for propelling it forwardly against the fastening element 25 located in the guide 23. When the gun is lifted from the target material 20, the movable parts within the housing return to the position shown in FIG. 3 and any unfired charge or residues of an incompletely burnt charge are returned into the magazine 29. Conventional means can be used for moving the magazine by one charge space so that another charge is ready for insertion into the firing chamber.

Figure 5:
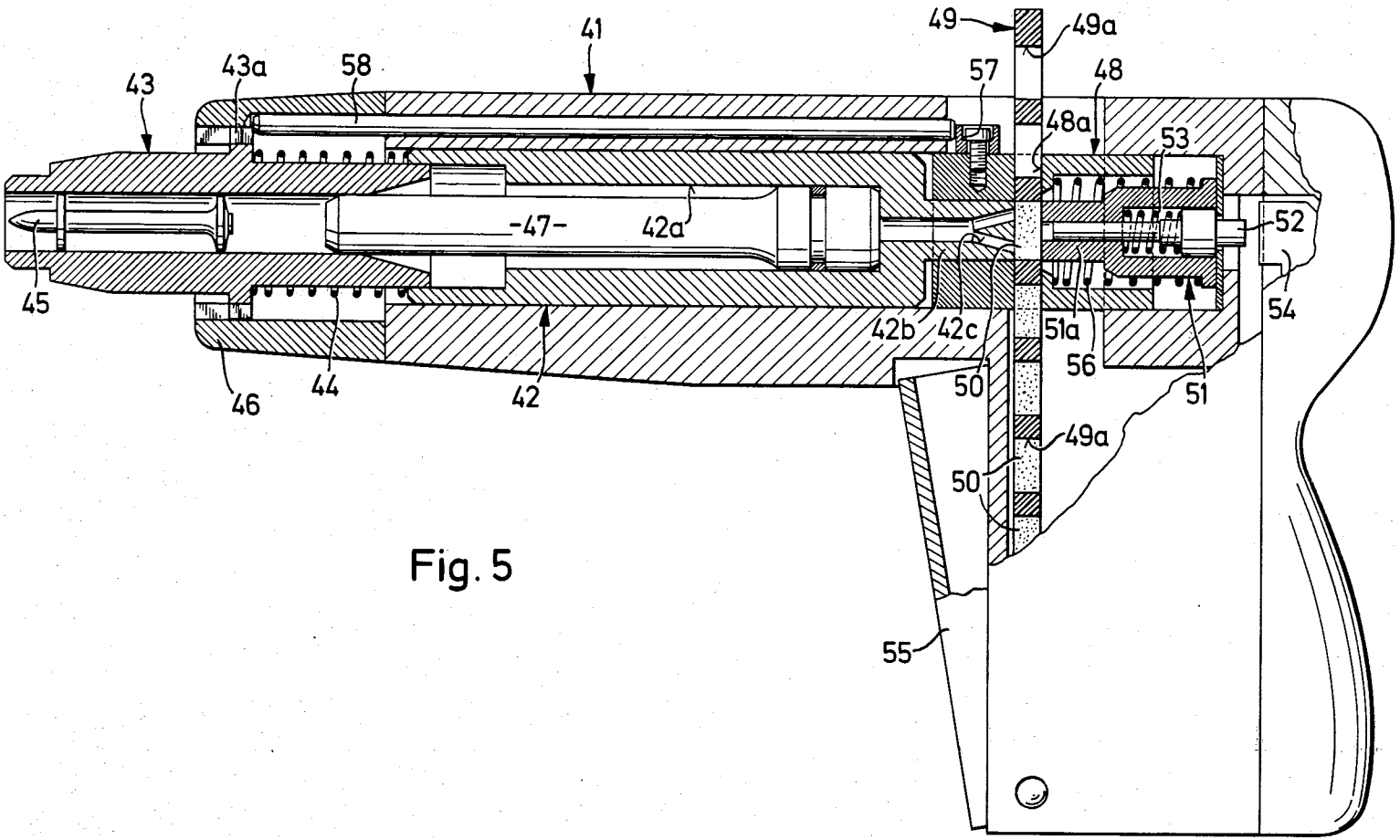
FIG. 5 is a side view, partly in section, of still another embodiment of the present invention with the barrel of the gun not pressed against the receiving material.

In FIG. 5 still another embodiment of a setting gun is shown incorporating the present invention. Mounted for axial displacement within a gun housing 41 is a barrel 42. A bolt guide 43 is positioned in front of the barrel 42 within the housing and the bolt guide is also axially displaceable relative to the housing. A compression spring 44 is positioned around the rearward outer surface of the guide 43 and bears at one end against the guide and at its other end against the front end of the barrel. Within the bore through the guide 43 is a fastening element 45. Connected to the front end of the housing 41 is a cap 46. The guide 43 and the cap 46 are designed in the manner of a bayonet lock, so that in the locked position compression spring 44 presses against an annular shoulder 43*a* of the guide and the shoulder is in bearing contact with the cap. By turning the guide 43 about its axis relative to the cap 46 it can be removed from the cap. A driving piston 47 is mounted within a guide bore 42*a* in the barrel and extends forwardly into the bore through the fastening element guide 43. The piston is axially displaceable through the barrel and the fastening element guide. At the rear end of the barrel an axially displaceable guide 48 is arranged. The guide 48 is sleeve-shaped and forms a magazine channel 48*a* extending perpendicularly to the axis of the barrel. In the magazine channel, a band-shaped magazine 49 is positioned containing caseless charges 50 in a number of spaced openings 49*a*. Located behind and extending axially into the guide 48 is a feed member 51 which is coaxially arranged with the barrel axis and is supported within the rear end of the housing. At its front end, the feed member 51 forms a mandrel 51*a* which has a transverse cross sectional shape which corresponds substantially to the shape of the openings 49*a* in the magazine 49. Further, a firing device extends through the feed member 51. The firing device consists of an axially displaceable firing pin 52 and a retaining spring 53 biasing the pin in the rearward direction. A firing hammer 54 is located rearwardly of the rear end of the firing pin 52 and when actuated by the trigger 55, drives the firing pin against the charge. Within the sleeve-like guide 48 and extending around the feed hammer 51 is a spring 56, with the forward end of the spring bearing against a flange-like lip on the front of the guide 48 and the rear end of the spring bearing against a shoulder adjacent the rearward end of the feed member 51. Spring 56 biases the guide 48 and the magazine 49 in the forward direction of the gun, that is, toward the fastening element guide 43, when the gun is not pressed against the receiving material. Fixed to the upper surface of the guide 48 is a stop 57 which bears against the rearward end of a bar 58 which extends in the axial direction of the gun through the housing 41 with the forward end of the bar contacting the shoulder 43*a* on the guide 43. When the front end of the gun is pressed against the target material, the fastening element guide 43 is displaced rearwardly and, as a result, the bar 58 moves rearwardly pressing against the stop 57 and causing the guide 48 to be displaced in the rearward direction relative to the housing 41 into the position shown in FIG. 6.

Figure 6:
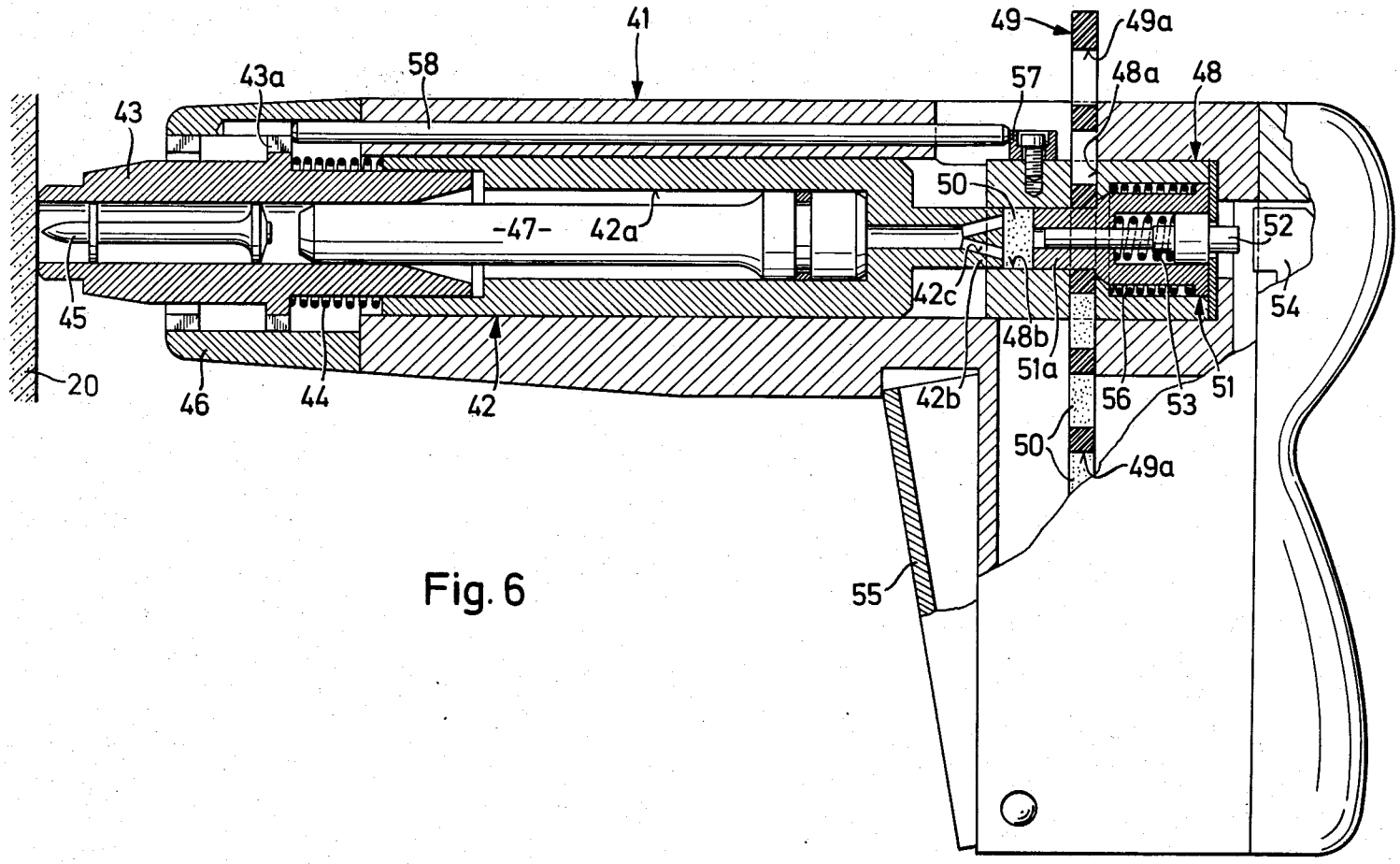
FIG. 6 is a view, similar to FIG. 5, however, with the barrel of the gun pressed against the receiving material.

FIG. 6 illustrates the position of the gun shown in FIG. 5 when the forward end of the fastening element guide 43 is pressed against the receiving material 20. When the guide is displaced rearwardly within the housing, the magazine 49 is also moved rearwardly, however, a charge 50 in the magazine is ejected by the front end or mandrel 51*a* of the feed member 41 and is then positioned within a firing chamber 48*b*. The firing chamber is formed between the rearward end of the barrel and the forward end of the mandrel 51*a* and is bonded laterally by the surface of a bore within the guide 48. As can be noted in FIGS. 5 and 6 when the fastening element guide 43 is displaced rearwardly it moves telescopically into the front end of the barrel pressing the spring 44. At the same time, the front end of the guide 48 is pressed rearwardly sliding over the rear end of the barrel 42. The rearward end of the barrel has a reduced diameter pin-shaped plunger section 42*b* which extends into the bore in the guide 48 and forms the forward end of the firing chamber. Combustion gases generated when a charge is ignited flow through channels 42c in the plunger section 42b and enter the rear end of the piston guide bore 42a where they act on the rearward end of the barrel 47 for propelling it forwardly against the fastening element 45 located within the guide 43. When the gun is removed from the position shown in FIG. 6, pressed against receiving material 20, the fastening element guide 43 and the guide 48 again return to the positions shown in FIG. 5 and any unfired charge or residue left from a fired charge are pushed by the plunger section 42b at the end of the barrel into the space in the magazine 49. Accordingly, each time the gun is returned to the position shown in FIG. 5 after having been displaced into the position shown in FIG. 6 the firing chamber 48b is cleared. As mentioned with respect to the embodiment shown in FIGS. 3 and 4, conventional means can be used for displacing the magazine through the housing for positioning the charges in alignment with the axis of the barrel 47 and the feed member 51.

Figure 7:
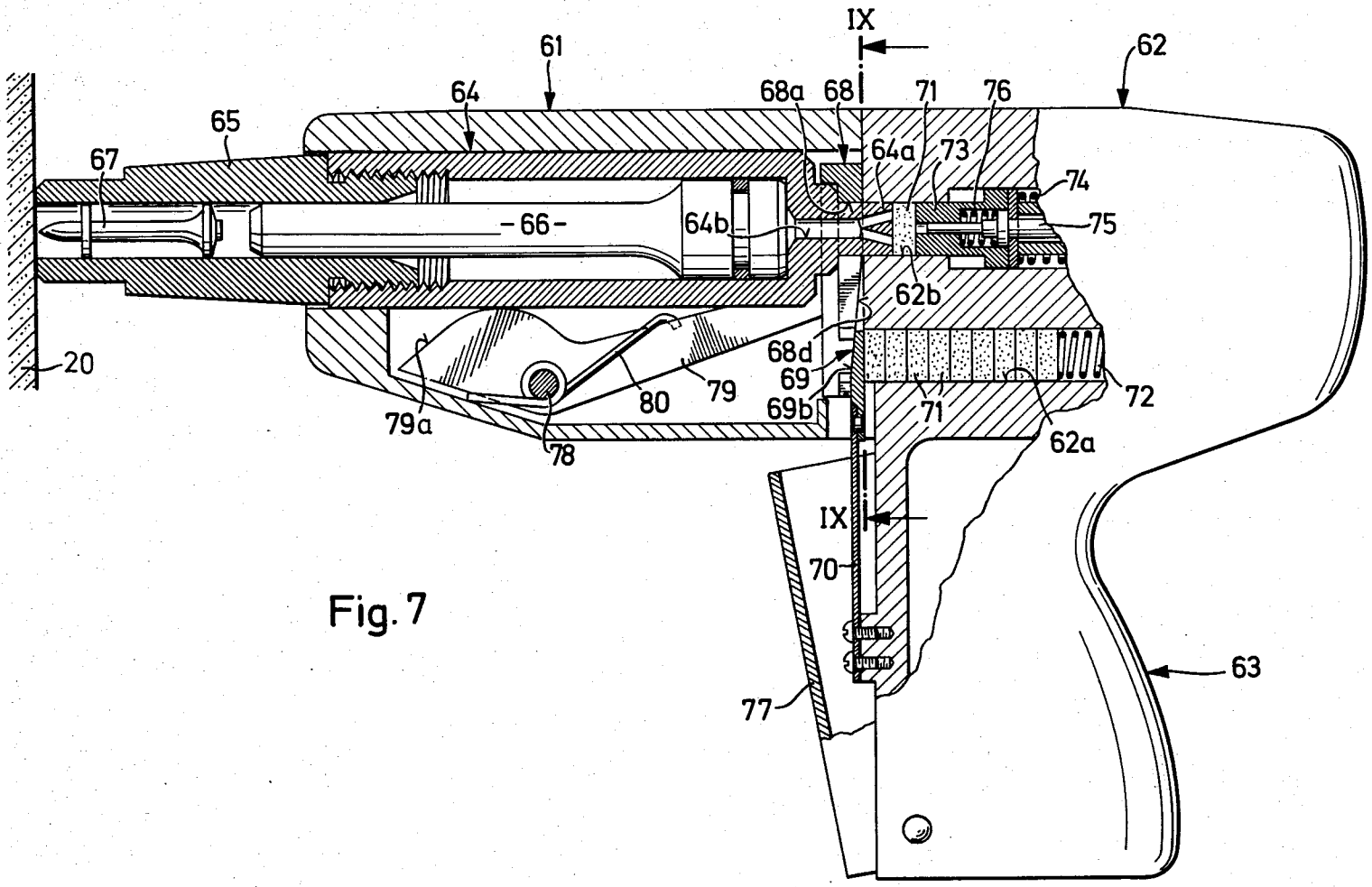
FIG. 7 is a side view, partly in section, of yet another setting gun embodying the present invention with the barrel of the gun pressed against the receiving material and the gun in the firing position.

In FIG. 7 a still further embodiment of a setting gun incorporating the present invention is illustrated and is shown with the forward end of the gun pressed against the receiving material 20. The setting gun includes a front housing part 61 and a rear breech part 62 with a handle 63 extending laterally outwardly from the breech part. An axially displaceable barrel 64 is positioned within the front housing part 61. Threaded into the forward end of the barrel is a bolt or fastening element guide 65. A driving piston 66 extends forwardly from the barrel into the fastening element guide. The head or rear end of the piston is in sliding contact with the bore in the barrel and the forward end of the piston is in sliding contact with the bore within the fastening element guide. The piston 66, when it is displaced axially forwardly through the barrel and guide, drives a fastening element or bolt 67 into the receiving material 20. Within the housing part 61 at the rear end of the barrel 64 is a slide 68 which moves transversely of the axis of the barrel. As seen in FIG. 7, a control element 69 is located within the lower end of the slide 68 and is positioned adjacent the breech part 62 side of the slide. It can be noted that the slide is located at the junction between the front housing part and the breech part. A leaf spring 70 is attached to the control element 69 and the spring extends downwardly from the control element and is riveted at its lower end to the handle 63. Within the breech part 62 below the axis of the barrel, is a magazine channel 62a disposed in parallel relationship with the barrel axis. Caseless propellant charges 71 are positioned, one following the other, within the magazine channel or duct 62a. The charges 71 are pushed forwardly through the magazine duct toward the control element 69 by a compression spring 72 located in the rearward end of the duct and contacting the rearward most one of charges. The rear end of the barrel affords a pin-shaped feed member 64a which extends into the breech part 62 for pushing a charge out of an opening 68a in the slide 68 when the gun is pressed against the target material, as shown in FIG. 7. The feed element 64a displaces the charge into a combustion chamber 62b formed within a bore extending axially through the breech part 62 in coaxial relationship with the combustion or firing chamber 62b which is bounded at its forward end by the rear end of feed member 64a. Opposite the barrel, the firing chamber is defined by the forward end of a plunger 73 which is axially displaceable within the breech part 62. The transverse cross section of the plunger corresponds to the cross section of the combustion chamber 62b. Within the breech part, a firing device is arranged, however, only a firing pin 75 and a retaining spring 76 are illustrated. In a conventional manner, the firing device is actuated by a trigger 77 positioned on the handle 63. Gases produced when a charge is fired, flow through channels 64b in the feed member 64a into the barrel where they provide the propelling force for driving the piston 66 forwardly against the fastening element 67 for inserting it into the receiving material.

Since it is axially displaceable within the breech part 62, the plunger 73 also serves as an ejection means for the firing chamber 62b. For instance, when the gun is lifted from the receiving material, a spring 74 located within the breech part rearwardly of the plunger displaces the plunger and the barrel 64 in the driving direction. Any unfired charge located between the front end of the plunger and the rear end of the feed element 64a or any incompletely burnt charge located in that space are returned into the opening 68a in the slide and the firing chamber 62b is cleared after each use.

Figure 8:
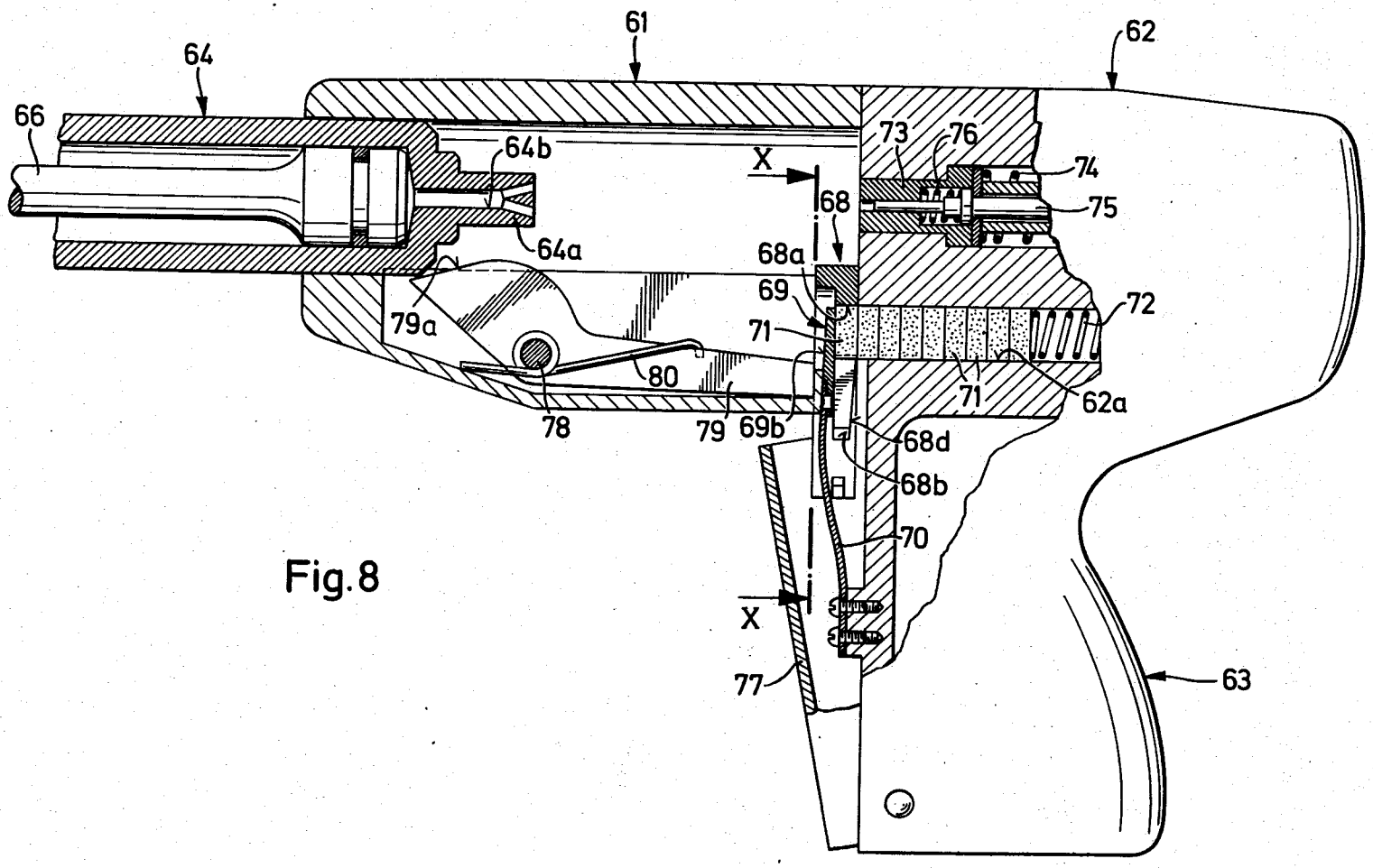
FIG. 8 is a partial view of the gun shown in FIG. 7 with the barrel not pressed against the receiving material and with the gun in the charge feeding position.

In FIG. 8, the gun is shown in the feeding position. This position is reached by pulling the barrel 64 outwardly from the housing 61. Located below the barrel in the front housing part 61 is a two-arm lever 79 pivotally connected to the housing about a pin or axis 78 which extends transversely of the axis of the barrel. The arm of the lever 79 extending forwardly from the axis 78, as viewed in FIG. 8, provides a cam surface 79a which, as viewed in FIG. 7, ordinarily contacts the lower surface of the barrel. A spring 80 is positioned about the pin or axis 78 and presses the cam surface upwardly against the barrel. The other arm of the lever which extends rearwardly through the housing is connected at its rear end with the slide 68. When the barrel is pulled forwardly out of the housing, the cam surface 79a pressed against the barrel turns in the clockwise direction and the slide attached to the opposite end of the lever is moved downwardly from the position shown in FIG. 7 toward the handle 63. The opening 68a previously aligned with the barrel is positioned in front of the outlet from the magazine duct 62a. The biasing action provided by the spring 72 forces the leading charge 71 within the magazine duct into the opening 68a in the slide and the control element is pressed forwardly against the biasing action of leaf spring 70 until it is positioned on the housing part 61 side of the slide. Since the movement of the control element in the forward direction is limited by a stop on the front housing part 61, only one charge can be displaced into the opening 68a in the slide 68. When the barrel is displaced rearwardly back into the front housing part 61, the action of the barrel riding over the cam surface 79a pivots the lever so that its rearwardly extending arm moves the slide upwardly conveying the charge toward the firing position while the control element 69 moves relative to the slide and through a second opening 68b to a position maintaining the remaining charges 71 within the magazine duct. While the slide moves upwardly and downwardly in a direction transverse to the axis of the barrel, the control element 69 remains aligned in front of the magazine duct.

Figure 9:
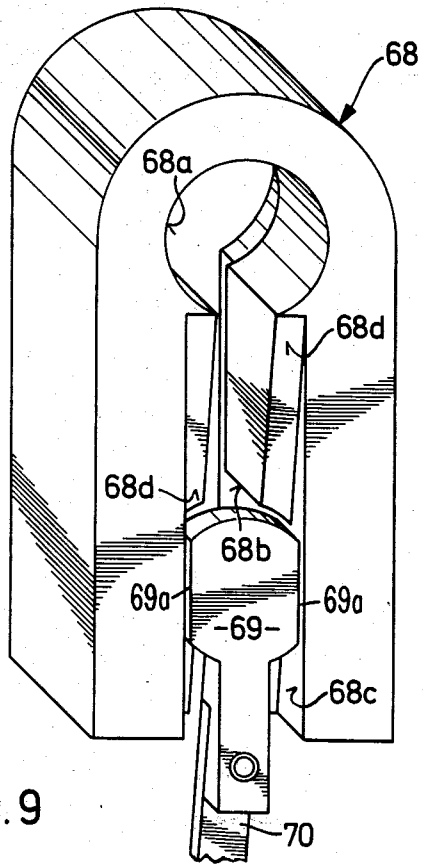
FIG. 9 is a perspective view of a portion of the gun as shown in FIG. 7 and taken along the line IX—IX.

In FIG. 9 the slide 68 and control element 69 are illustrated in the position of the gun represented in FIG. 7 along the line IX—IX. For the sake of clarity, no charge is shown within the opening 68*a*. The control element 69 is secured to the upper end of leaf spring 70 and is positioned in alignment with the passage 68*b* in the slide. Further, as can be noted in FIG. 7, the control element forms a closure for the forward end of the magazine duct 62*a*. As can be seen in FIG. 7, control element 69 is in the form of a trowel. The opposite sides of the control element are cut off, that is, segment-shaped parts are removed so that surfaces 69*a* are provided which guide the control element through the surfaces of the guide groove 68*c* within the slide. As can be seen in FIG. 9, cam surfaces 68*d* are formed in the guide groove 68*c* and provide abutting surfaces for the control element during the relative movement of the slide and the control element. The object of the cam surfaces 68*d* which are inclined with respect to the vertical, is to press the face of the control element 69 against the opening or outlet from the magazine duct 62*a* as the slide is moved upwardly from the position shown in FIG. 8 to that represented in FIG. 7.

Figure 10:
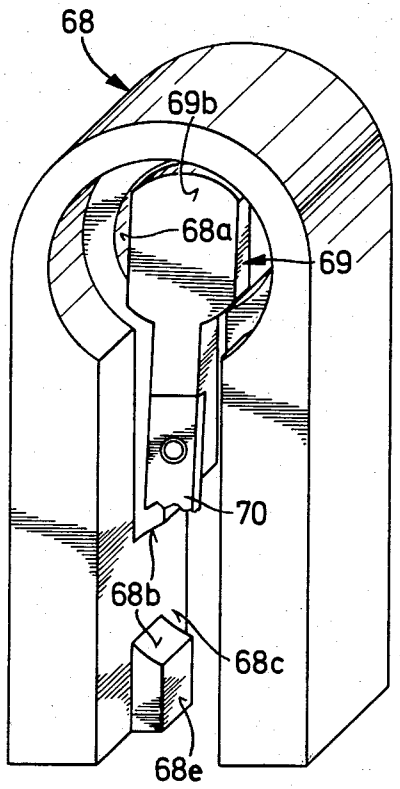
FIG. 10 is another perspective view of the portion of the gun shown in FIG. 9 but taken along the line X—X in FIG. 8.

In FIG. 10, the slide 68 and control element 69 are shown in the position disclosed in FIG. 8 along the line X—X. Slide 68 is shown here in its disengaged position, that is, in position to receive a charge 71 so that it can be moved into the firing position. Due to the relationship between the inclined forwardly facing surface of the control element 69 and the rearwardly facing inclined cam surfaces 68*d*, as the slide moves downwardly the control element remains in position at the outlet from the magazine duct. When the opening 68*a* finally aligns itself in front of the outlet from the magazine duct, the control element is displaced forwardly by the action of the compression spring through the opening 69*a* so the the forwardmost charge within the duct can move into the opening 68*a* in the slide. The spring 72 moves the control element against the action of the spring 70 so that it is located on the forwardly facing side of the slide 68. Any unignited charge which remained in the opening or the residue from any fired charge is ejected by the control element forwardly out of the opening 68*a*. The movement of the control element through the slide, that is in the direction of the axis of the barrel, is limited by contact with the housing 61. The rearwardly facing surface of the slide effects the retention of the charges within the magazine duct as the slide is moved upwardly toward the position shown in FIG. 7. When the slide reaches its upward position the control element is biased rearwardly by leaf spring 70 through the passage 69*b* in the lower end of the slide so that it returns to the locking position at the outlet from the magazine duct 62*a* as shown in FIG. 7, this is the same position as illustrated in FIG. 9. As mentioned above, the forwardly facing side of the control element 69 has an inclined sliding surface which corresponds to the inclined cam surface 68*d* on the slide. When the slide is being disengaged, that is, when it is being moved downwardly from the position of FIG. 7 into that of FIG. 8, the sliding surface 69*b* rides along the cam surface 68*d* and the control element is pressed against the outlet from the magazine duct. Charges are retained within the duct against the action of the compression spring. When the slide has been moved to its lower position, the leaf spring 70 attached to the control element 69 also moves through a slotted passageway 68*e* in the lower end of the slide permitting the forward displacement of the control element.

While specific embodiments of the invention have been shown and described in detail to illustrate the application of the inventive principles, it will be understood that the invention may be embodied otherwise without departing from such principles.

What is claimed is:

1. Explosive charge driven setting gun for driving fastening elements, such as bolts, nails and the like, into a hard receiving material, such as concrete, steel and the like, comprising a gun housing, an axially elongated barrel mounted within said housing and having a front end and a rear end, a charge holding member located within said housing and positioned adjacent the rear end of said barrel, said holding member having at least one recess therein for holding a caseless charge, a firing chamber within said housing adjacent both said holding member and the rear end of said barrel, a feed member located within said gun housing for displacing individual ones of the caseless charges from said holding member into the firing chamber wherein the improvement comprises a plunger located within said gun housing on the opposite side of said firing chamber from said feed member and said plunger having a cross sectional shape transverse to the axial direction of said barrel which corresponds substantially to the cross sectional shape of said firing chamber extending transversely of the axial direction of said barrel and said plunger being displaceable through said firing chamber and said feed member and said plunger being arranged coaxially of one another.

2. Explosive charge driven setting gun, as set forth in claim 1, wherein said plunger defines one side of said firing chamber.

3. Explosive charge driven setting gun, as set forth in claim 2, wherein said feed member defines the opposite side of said firing chamber from said plunger.

4. Explosive charge driven setting gun, as set forth in claim 1, wherein said recess in said holding member comprises an opening extending therethrough.

5. Explosive charge driven setting gun, as set forth in claim 4, wherein said holding member is a magazine having a number of space openings therein for holding caseless charges.

6. Explosive charge driven setting gun, as set forth in claim 5, wherein said magazine having an elongated rectilinear strip shape.

7. Explosive charge driven setting gun, as set forth in claim 4, wherein said feed member has a cross sectional shape transverse to the axis of said barrel which corresponds substantially to the cross sectional shape transverse to the axis of said barrel of said opening in said holding member.

8. Explosive charge driven setting gun, as set forth in claim 7, wherein said feed member is cylindrically shaped and is displaceable along an axis parallel to the axis of said barrel.

9. Explosive charge driven setting gun, as set forth in claim 8, wherein the cross sectional shape of said feed member, of the recess in said holding member, of said firing chamber, and of said plunger in the direction transverse to the axial direction of said barrel are substantially the same.

10. Explosive charge driven setting gun, as set forth in claim 1, wherein said holding member comprises a slide.

11. Explosive charge driven setting gun, as set forth in claim 10, wherein said slide has a slot therein extending transversely of the axial direction of said barrel, the recess in said slide is an opening extending through said slide in the axial direction of said barrel and located at one end of said slot, a control element mounted in said housing and positioned within said slot in said slide, said slide and control element being displaceable in the direction of said slot relative to one another.

12. Explosive charge driven setting gun, as set forth in claim 11, wherein a spring is attached to said control element and said spring is fixed to said housing, said spring biasing said control element in the direction away from the front end of said barrel.

13. Explosive charge driven setting gun, as set forth in claim 12, wherein said slide has a cam surface located within said slot and extending in the direction of said slot with said cam surface being located in the path of the relative movement between said slide and control element, said cam surface arranged to contact and displace said control element in the direction away from the front end of said barrel.

14. Explosive charge driven setting gun, as set forth in claim 11, wherein a two-arm lever is mounted in said housing having a cam surface on one of said arms with said cam surface disposed in contact with the surface of said barrel and the other said arm being attached to said slide, spring means fixed to said lever for biasing said cam surface into contact with said barrel, said barrel being axially displaceable over said cam surface on said lever and said lever being arranged to effect a pivoting action under the biasing effect of said spring means for effecting displacement of said slide within said housing.

15. Explosive charge driven setting gun, as set forth in claim 11, wherein said control element has a lateral shape which permits the element to be displaced through the opening in said slide.

16. Explosive charge driven setting gun, as set forth in claim 15, wherein said slot has a transverse passage at the opposite end thereof from said opening for permitting said control element to move through said passage from one side of said slide to the other.

17. Explosive charge driven setting gun, as set forth in claim 1, wherein said barrel has an axially extending bore therein, a piston positioned within said bore for propelling fastening elements from the forward end of said barrel, and passages extending through the rearward end of said barrel into said bore for conveying explosive gases generated when a charge is fired into the bore in said barrel.

18. Explosive charge driven setting gun, as set forth in claim 1, wherein a two-arm lever is mounted in said barrel, a cam surface on one of the arms of said lever exposed in contact with said barrel, the other one of the arms of said lever being secured to said holding member, so that movement of said barrel over said cam surface causes a pivoting movement of said lever and effects the displacement of said holding member.

19. Explosive charge driven setting gun, as set forth in claim 1, wherein said feed member and plunger are disposed in parallel relation with said barrel disposed laterally outwardly from said barrel in said gun housing, said barrel having a bore therethrough, a piston axially displaceably mounted in said bore, said barrel having a passageway extending laterally outwardly from said bore at the rearward end of said barrel for affording passage of explosive charge gases from said firing chamber into the bore in said barrel.

* * * * *